US005154219A

United States Patent [19]

Watson et al.

[11] Patent Number: 5,154,219

[45] Date of Patent: Oct. 13, 1992

[54] PRODUCTION OF SPRAY CAST STRIP

[75] Inventors: W. Gary Watson, Cheshire; Michael A. D'Onofrio, Branford; Carlos J. Rivera, West Haven; Melillo Thomas J., East Haven, all of Conn.

[73] Assignee: Olin Corporation, Cheshire, Conn.

[21] Appl. No.: 636,451

[22] Filed: Dec. 31, 1990

[51] Int. Cl.[5] ..... B22D 23/00; B22D 19/00

[52] U.S. Cl. ..... 164/46; 164/461

[58] Field of Search ..... 164/46, 461, 419; 118/325; 427/424

[56] References Cited

U.S. PATENT DOCUMENTS

| | | | |
|---|---|---|---|
| 2,639,490 | 5/1953 | Brennan | 164/427 |
| 3,775,156 | 11/1973 | Singer | 117/65.2 |
| 3,826,301 | 7/1974 | Brooks | 164/46 |
| 3,909,921 | 10/1975 | Brooks | 29/527.2 |
| 4,779,802 | 10/1988 | Coombs | 239/292 |
| 4,977,950 | 12/1990 | Muench | 164/429 |

FOREIGN PATENT DOCUMENTS

| | | |
|---|---|---|
| 0225080 | 6/1987 | European Pat. Off. . |
| 1379261 | 1/1975 | United Kingdom . |
| 1472939 | 5/1977 | United Kingdom . |

OTHER PUBLICATIONS

R. W. Evans et al., "The Osprey Preform Process", Powder Metallurgy, vol. 28, No. 1, 1985, pp. 13-20.

A. G. Leatham et al, "The Osprey Process for the Production of Spray-Deposited Roll, Disc, Tube and Billet Preforms", Modern Developments in Powder Metallurgy vols. 15-17, 1985, pp. 157-173.

S. Asai, "Birth and Recent Activities of Electromagnetic Processing of Materials", ISIJ International, vol. 28, 1989, No. 12, pp. 981-992.

*Primary Examiner*—Kuang Y. Lin

*Attorney, Agent, or Firm*—Bruce E. Burdick; H. Samuel Kieser

[57] ABSTRACT

The spray casting of metal wherein an atomized spray of metal droplets is caused to be deposited upon a moving metallic foil substrate. The metallic foil substrate is maintained under tension as it passes in a position to receive the deposit such that thermal distortion is eliminated without causing tensile failure. In the second embodiment, the leading edge of the spray is positioned such that it does not contact the foil whereby the low mass density thereof does not contribute to deposit helping to eliminate bottom porosity.

3 Claims, 2 Drawing Sheets

PRESSURIZED GAS INFLOW

PRODUCTION OF SPRAY CAST STRIP

BACKGROUND OF THE INVENTION

1. Field of the Invention

The present invention relates generally to the spray casting of molten metal onto a moving substrate to form a solidified strip of product and, more particularly, relates to a method and apparatus in which a foil is used as the substrate and is continuously moved underneath the spray for receipt of the deposit of metal.

2. BACKGROUND INFORMATION

A process for the production of spray-deposited shaped preforms has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process" by R.W. Evans et al, *Powder Metallurgy, Vol.* 28, No. 1 (1985), pages 13–20 and ""The Osprey Process for the Production of Spray-Deposited Roll, Disc, Tube and Billet Preforms" by A. G. Leatham et al, *Modern Developments in Powder Metallurgy*, Vols. 15–17 (1985), pages 157–73.

The Osprey process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a mechanism which is programmed to perform a sequence of movements within the spray, so that the desired preform shape can be generated. The preform can then be further processed, normally by hot-working, to form a semi-finished or finished product.

The spray deposition process has been proposed for producing strip or plate or spray-coated strip or plate, as disclosed in U.S. Pat. Nos. 3,775,156 and 4,779,801 and European Pat. Appln. No. 225,080. For producing these products, a substrate or collector, such as a flat substrate or an endless belt, is moved continuously through the spray to receive a deposit of uniform thickness across its width.

In the case of the production of strip, the substrate onto which the atomized droplets are deposited is an important component of the system. The substrate must function to ensure that the initial droplets of the spray adhere upon splatting to provide a flat bottom surface. In addition, the substrate must also not extract an excessive amount of heat so as to permit sufficient liquid to fill the intersticies between adjacent splats. Porosity will occur when the initial semi-solid deposit layer contains too much solid or is cooled too rapidly by the substrate and provides insufficient liquid to feed the inherent intersticies between the splatted droplets.

In order to produce spray cast strip, the substrate must also be capable of traversing beneath the spray in a continuous manner. Various substrate systems have been proposed including endless belt and rotating wheel configurations. With such systems, several problems arise. Unless the substrate is preheated which may be difficult due to the cooling afforded by the high velocity atomizing gas, too much heat is extracted from the initial splats which promotes porosity in the cast structure. Another problem that may arise is if the substrate becomes excessively hot, sticking may occur whereby the deposits cannot be readily separated from the substrate.

In co-pending U.S. Patent Application, Ser. No. 07/635,090 entitled "Substrate for Spray Cast Strip", in the name of W. G. Watson et al there is disclosed the use of a limited heat-absorptive outer thin foil substrate having limited heat absorption capabilities. However, it has been found that merely using the foil as a substrate is not completely satisfactory. The heat flux from the leading edge of the spray will cause thermal expansion of the foil which may produce wrinkles in the foil or possibly cause the foil to tear. This will result in poor bottom surface characteristics of the cast strip product such as unevenness or excessive porosity.

SUMMARY OF THE INVENTION

The present invention overcomes the above problems through the provision of an apparatus for the spray casting of a metal which comprises means for providing an atomized spray of metal droplets and a moving substrate for receiving a deposit of the spray of droplets. The substrate comprises a metal foil. The apparatus additionally comprises means for maintaining the foil under tension as it passes through the position at which it receives the deposit.

In accordance with the process of the present invention, a stream of molten metal is atomized into a spray. A substrate is moved in a position to receive a deposit of the spray of particles. The substrate is in the form of a metallic foil. The metallic foil is maintained under tension as it passes through the position at which it receives the deposit.

DESCRIPTION OF THE DRAWINGS

The present invention may be more readily understood by reference to the following description and to the accompany drawings in which.

DETAILED DESCRIPTION OF THE INVENTION

Figures 1, 2:
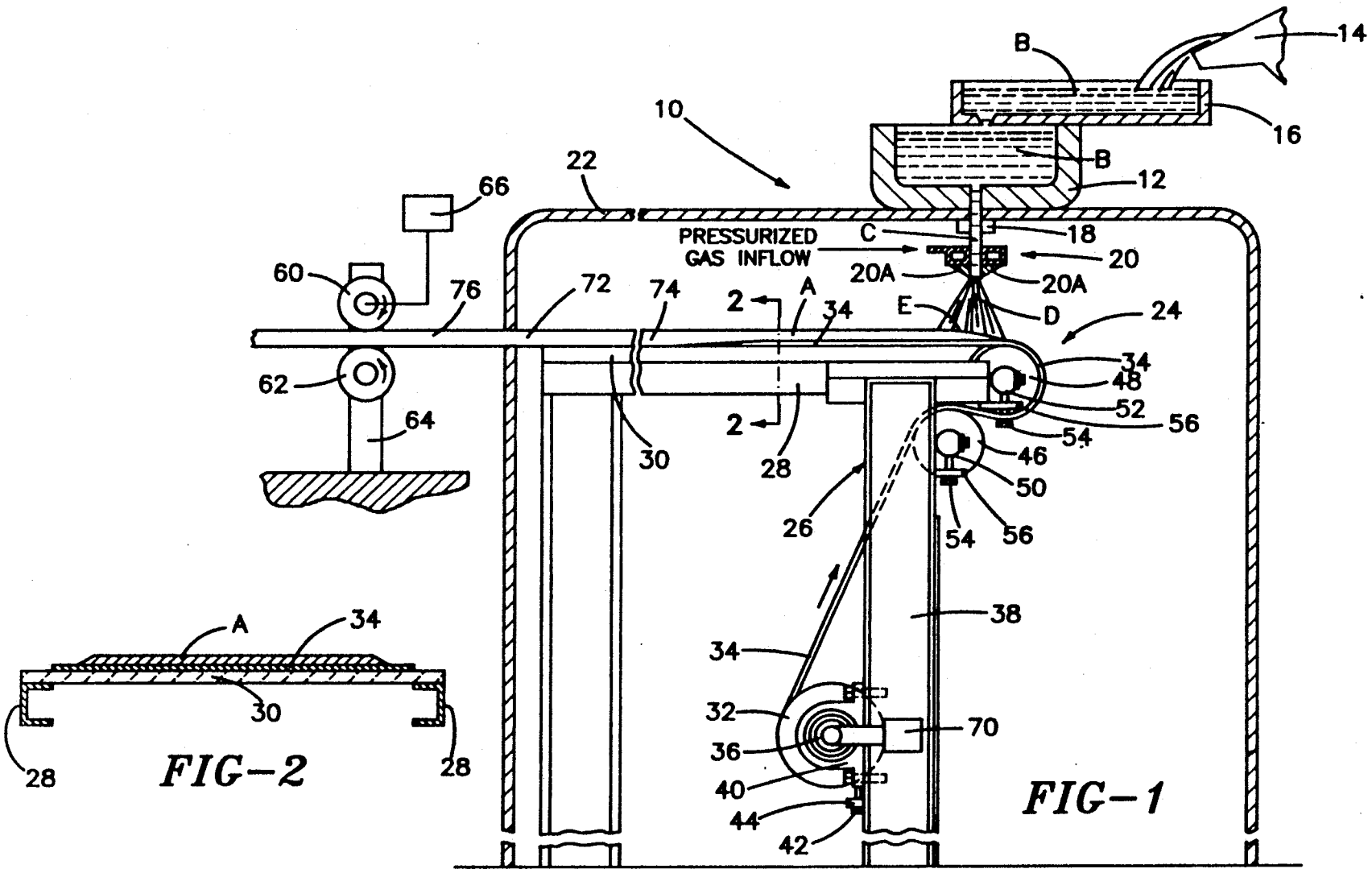
FIG. 1 is a schematic side view, partially in section, of a first embodiment of an apparatus incorporating the principles of the present invention.
FIG. 2 is a partial sectional view taken along the lines 2—2 of FIG. 1.
Figure 3:
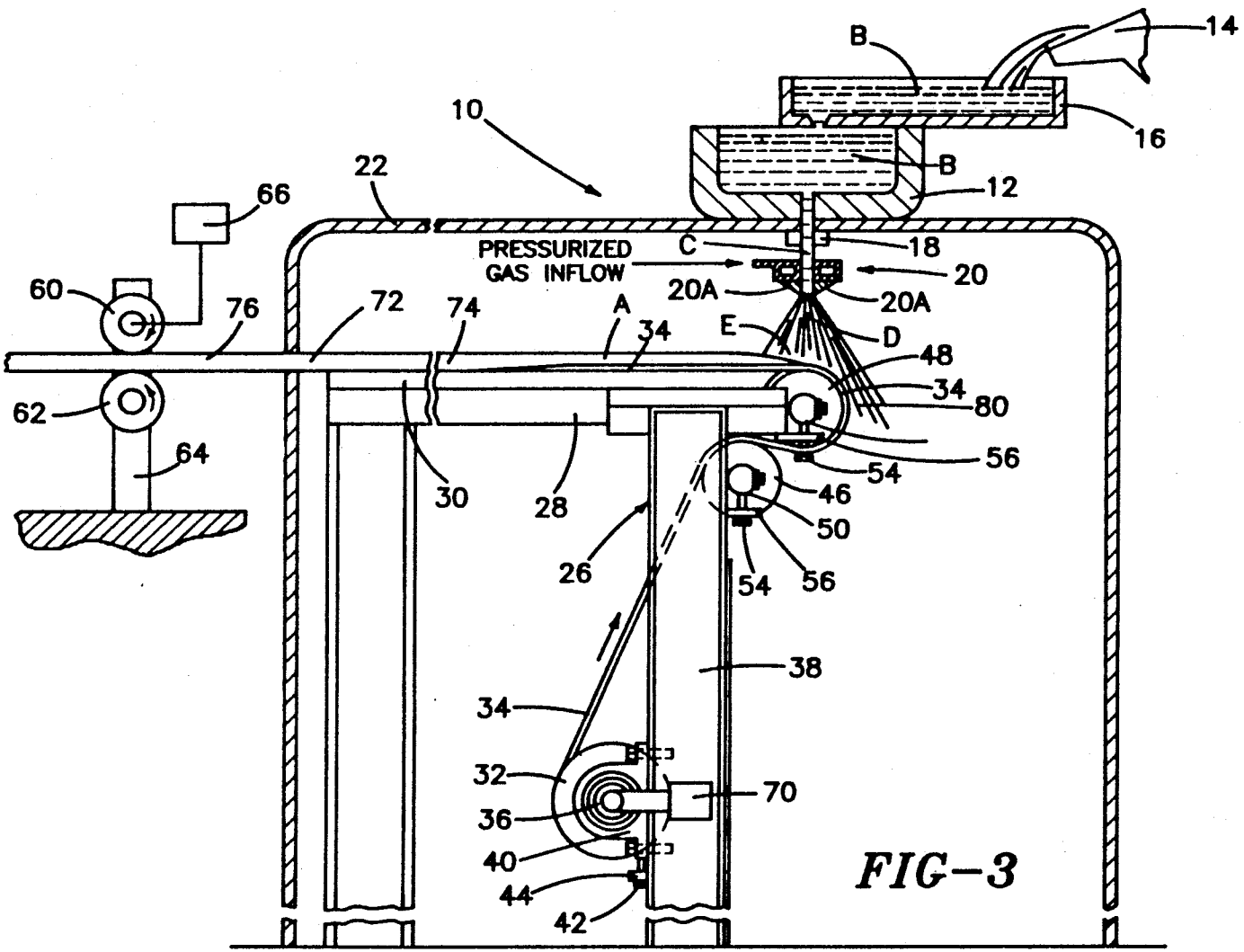
FIG. 3 is a schematic side view, partially in section, of a second embodiment of an apparatus incorporating the principles of the present invention.

Referring now to the drawings, FIG. 1 schematically illustrates a casting apparatus 10 which is adapted for the continuous formation of a metal Product A in strip form. An example of a suitable Metal B is copper and its alloys. The apparatus 10 may employ a tundish 12 in which the metal B is held in molten form. The tundish 12 receives the molten metal B from a tiltable melt furnace 14, via a transfer launder 16, and has a bottom nozzle 18 through which the molten metal B issues in a stream C downwardly from the tundish 12.

An atomizing device 20 employed by the apparatus 10 is positioned below the tundish bottom nozzle 18 within a spray chamber 22 of the apparatus 10. The atomizing device 20 may be a gas atomizer and accordingly is supplied with a gas, such as nitrogen, under pressure from any suitable source. The gas-atomizing device 20 which surrounds the molten metal stream C has a plurality of jets 20A symmetrically positioned about the stream C. The atomizing gas is thereby impacted or impinged on the stream from all sides and directions about the stream so as to convert the stream into a spray D of atomized molten metal particles or droplets, broadcasting downwardly from the atomizing device 20 in the form of a divergent conical pattern. If desired, more than one atomizer may be used. Also, the atomizer(s) may be moved transversely in side-to-side fashion for more uniformly distributing the metal particles.

A substrate system 24 is mounted within the spray chamber 22 and includes a frame 26 having upper horizontally disposed frame members 28 upon which a flat platform or table 30 is mounted. This platform 30 may be fabricated from a highly insulative ceramic materials such as PYROTEK board or glass ceramic materials such as PYREX.

A roll or spool 32 of metallic foil 34 is mounted on a shaft 36 extending between two bearings 40 which are adjustably mounted on a respective one of the vertical frame members 38 (only one frame member and bearing is shown in FIG. 1). Each of the bearings 40 may be adjusted by means of an adjustable screw 42 mounted in a stationary block 44 in a position to engage the bottom surface of the bearing 40 as shown in FIG. 1. By virtue of the adjustable screws, the axes of the roll 36 may be adjusted to assist in the proper alignment of the foil 34.

The metallic foil 34 extends from the roll 32 through a series of adjustable rolls 46 and 48 mounted adjacent the top of the frame 26, the foil 34 as shown in FIG. 1 extends across the top side of the table or platform 30 in a position underneath the atomizer 20. Each of the rolls 46 and 48 are rotatably mounted on a respective shaft 50 and 52 each of which is adjustably attached to the frame 26 as shown. Adjustment of the axes of the rolls 46 and 48 may be achieved by means of adjustable screws 54 which are mounted in stationary blocks 56 attached to the frame 26.

The table or platform 30 extends rearwardly (to the right as viewed in FIG. 1) into a position adjacent the upper roll 48. Additionally, the height of the platform 30 is such that its upper planar surface is substantially in a plane tangent to the upper most point of the upper roll 48 so that the foil 34 is maintained in a generally horizontal plane during its upper run across the table or platform 30.

The foil 34 may be as of the type and thickness as described in the above mentioned co-pending U.S. patent application. The foil should be selected to sufficiently reduce and limit heat extraction from the metal particles forming the droplets when they ultimately come in contact with the outer surface of the foil 34. This will Prevent complete solidification of the initial deposit and thereby permit production of a dense strip Product A having minimal porosity. More specifically, the foil should have a thickness which is less than a predefined maximum thickness at which the capacity of the foil to absorb heat from the deposit is equal to the latent heat, and super-heat if present, of the deposit. The foil thickness thus precludes reduction in temperature below the solidus temperature of the deposit and complete solidification of the metal particles forming a deposit on initial contact with the foil surface. The predefined maximum thickness of the outer foil substrate 34 is derived by equating the latent heat, and superheat if present, of the deposit E with the heat the foil substrate 34 is capable of absorbing between its lower steady state temperature and the higher deposit solidus temperature. The steady state temperature of the outer foil substrate 34 is substantially determined by the steady state temperature of the pressurized gas employed by the atomizer 20. Thus, the thickness of the thin metallic foil substrate 34 is preselected to set the capacity of the foil 34 to absorb heat from the deposit E at a maximum limit which prevents complete solidification of the initial metal particles forming the initial part of the deposit E, whereby a fraction of liquid will be present to wet subsequent metal particles contacting the surface of the foil 34.

Copper or steel foil is generally preferred, although in some cases, depending upon the temperature of the alloy being cast, it may be more advantageous to use steel since it has a higher melting point than that of copper. The steel used may be any alloy form ranging from low carbon steel to stainless steel.

The thickness of the foil 34 must be sufficient such that the foil has strength enough to be moved underneath the atomizer 20 without tearing. However, the thickness should be less than a predefined maximum thickness at which the capacity of the foil to absorb heat from the deposit is equal to the latent heat and superheat present in the deposit as described above. Generally, either steel or copper foil having a thickness in the range of from about 0.002 inches to about 0.006 inches may be used.

The foil 34 is maintained under tension through the provision of oppositely disposed drive rolls 60, 62 positioned outside of the chamber 22, downstream of the atomizer 20, and mounted on a suitable frame member 64. The drive rolls 60, 62 may be driven by any suitable type of motor such as variable speed electric motor, servo motor or .hydraulic motor shown schematically by the reference numeral 66. The motor 66 may drive one or both of the rolls 60, 62. If both are driven, they should be driven in synchronization in opposite directions. The rolls 60, 62 may also be spring biased to adjust for different thicknesses of the material passing therebetween.

The shaft 36 upon which the roll 32 of foil is drivenly mounted is connected to a suitable mechanism such as an air brake mechanism or variable clutch mechanism shown schematically by the Reference Numeral 70 to retard the speed of the foil 34 being played off the roll 32.

At the commencement of a cast, the foil 34 passes over the rollers 46 and 48, across the top of the platform or table 30, as shown, and is attached to a bait bar 72. The bait bar 72 includes a rearward end 74 to which the foil 34 is attached and a forwardly extending planar portion 76 which extends initially out of the chamber and through the drive rolls 60 and 62 in driven engagement therewith. The bait bar 72 may be fabricated from a suitable material such as plain carbon steel or stainless steel.

Before the spray casting begins, the foil is placed under initial tension by means of the drive rolls 60 and 62 and retarding mechanism 70. The bait bar 72 to which the forward end of the foil 34 is attached, is engaged by the drive rolls 60 and 62 to advance the bait bar 72 and the foil 34 in opposition to the retarding action of the retarding mechanism 70 to place the foil under suitable tension. With the system at rest, and the forward portion of the foil 34 positioned underneath the atomizer 20, the casting is started and the drive rolls 60 and 62 engage the forward end 76 of the bait bar 72. The initial spray of molten metal is deposited on the foil and partially on the bait bar 72. As the drive rolls 60 and 62 drive the bait bar 72 to the left as viewed in FIG. 1, the foil 34 moves underneath the spray whereby a deposit E of metal is placed on the foil 34. As the deposit of metal droplets on the foil moves across the platform 30 with the foil 34, away from the deposit area, the deposited layer solidifies forming a solidified continuous strip product which eventually passes through the drive rolls 60 and 62 and is engaged thereby for continued movement of the foil 34 substrate with the foil 34 being maintained under tension due to the retarding action of the retarding mechanism 70 acting on the shaft 36 upon which the spool of foil is mounted.

The foil itself may become welded to the solidified deposit depending upon the thickness of the foil. As such, the foil may be considered consumable and is removed by subsequent conventional milling operation. If the temperature of the initial deposit and thickness of the foil is such that the foil does not become welded to the resulting solidified cast deposit, the foil may be stripped from the product and rolled for later re-use. The cast strip itself after it passes through the drive rollers may be immediately processed such as by rolling or the like or may be coiled for later processing.

With the apparatus just described, the metallic foil is maintained under tension so that a flat surface will be present in a position underneath the atomizer to receive the deposit of molten droplets so that the heat flux from the leading edge of the spray will not cause thermal expansion of the foil which could cause distortion of the foil surface. The amount of tension should be sufficient to maintain a flat surface without causing tensile failure.

By way of an example, it has been found that 0.002" stainless steel foil tensioned to 1000 psi was sufficient to accommodate the thermal expansion during the spray casting of copper alloys.

Referring to FIG. 2, a second embodiment of an apparatus is shown. The apparatus is similar to to that of FIG. 1 except that the atomizer 20 is positioned such that the leading edge 80 of the divergent spray pattern D does not fall on the foil substrate 34, but rather oversprays the foil 34 positioned about the upper roller 48 as shown. With this embodiment, by overspraying the leading edge 80 of the spray pattern, the contribution of the low mass density of the leading edge of the spray to the deposit is eliminated, helping to reduce excessive porosity.

While the invention has been described above with reference to a specific embodiment thereof, it is apparent that many changes, modifications and variations can be made without departing from the inventive concept disclosed. Accordingly, it is intended to embrace all such changes, modifications and variations that fall within the spirit and broad scope of the appended claims. All publications cited herein are incorporated by reference in their entirety.

What is claimed is:

1. A process for the spray casting of metal comprising:

atomizing a stream of molten metal into a spray of metal droplets within a spray chamber, moving a substrate of metallic foil in a position within the spray chamber to receive a deposit of said spray of droplets, and pulling on the substrate in the direction of movement from a first location outside the spray chamber and pulling on the substrate in the direction opposite to the direction of movement from a second location to maintain said metallic foil under tension as it passes through the position at which it receives said deposit and out of the spray chamber, the tension on the substrate being greater than the thermal expansion forces on the substrate during receipt of the deposit and being less than the tensile strength of the substrate.

2. The process of claim 1 wherein said foil is maintained under a tension such that distortion due to thermal expansion is eliminated without causing tensile failure.

3. The process of claim 1 wherein said spray of metal droplets is deposited such that the leading edge of the spray pattern does not contact the foil.

* * * * *